US011041319B1

(12) United States Patent
Hernandez

(10) Patent No.: US 11,041,319 B1
(45) **Date of Patent: *Jun. 22, 2021**

(54) JOINT COMPOUND SPREADING TOOL FOR DRYWALL FINISHING

(71) Applicant: Michael Hernandez, Staten Island, NY (US)

(72) Inventor: Michael Hernandez, Staten Island, NY (US)

(73) Assignee: HERNANDEZ FAMILY ASSETS LLC, Staten Island, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/149,507

(22) Filed: Jan. 14, 2021

(51) Int. Cl.
*E04F 21/16* (2006.01)
*E04F 21/165* (2006.01)
*E04F 21/02* (2006.01)

(52) U.S. Cl.
CPC ..... *E04F 21/1652* (2013.01); *E04F 21/026* (2013.01); *E04F 21/1655* (2013.01)

(58) Field of Classification Search
CPC ..... E04F 21/165; E04F 21/1652
See application file for complete search history.

(56) References Cited

U.S. PATENT DOCUMENTS

| | | | | |
|---|---|---|---|---|
| 2,800,672 | A * | 7/1957 | Gilyan | E04F 21/06 15/105 |
| 4,654,919 | A * | 4/1987 | Liberman | E04F 21/06 15/235.4 |
| 7,698,774 | B1 * | 4/2010 | Coon | B05C 17/10 15/235.8 |
| 10,760,288 | B2 * | 9/2020 | Hernandez | E04F 21/1652 |
| 2002/0002754 | A1 * | 1/2002 | Wendel | E04F 21/06 15/245.1 |
| 2008/0295435 | A1 * | 12/2008 | Uva | E04F 21/1652 52/514 |

* cited by examiner

*Primary Examiner* — Randall E Chin
(74) *Attorney, Agent, or Firm* — Andrew Berks

(57) ABSTRACT

A hand tool is provided for the application of joint compound to drywall board joints, a planar blade affixed to a handle. The blade has a concave arcuate working edge, wherein the concave arcuate curve extends the entire length of the working edge to each corner of the working edge. The concave arcuate working edge may be used to apply a self-featured layer joint compound over drywall tape on planar butt joint or an inside corner joint. The blade is laterally flexible.

3 Claims, 4 Drawing Sheets

JOINT COMPOUND SPREADING TOOL FOR DRYWALL FINISHING

FIELD OF THE INVENTION

This invention pertains to a hand tool for the application of joint compound to drywall joints in buildings construction.

BACKGROUND

Walls in buildings construction are typically formed from sheets of drywall nailed or screwed to wood or metal framework. The sheets of drywall are variously referred to as plasterboards, wallboard, SHEETROCK, and other names, which are generally interchangeable here. Drywall for most walls is fabricated from a gypsum core with a paper exterior that can be painted or finished with some other surface when complete. Gypsum drywall has the advantage of being fairly easy to cut and install, and imparts a degree of fire-proofness on the final construction. Other specialized wall boards are available for example, boards made from concrete for wet environments.

The joints between sheets of drywall are conventionally finished by applying a layer of joint compound, embedding a strip of drywall tape in the wet joint compound, and applying one or more additional layers of joint compound over the tape with various knives, blades, and other tools to smooth the joint compound covering the joint and the tape in order to obtain a smooth finish without a visible seam. For the purpose of this disclosure, the term "joint compound" includes products known as wall mud, plaster, or Spackle intended for use in covering joints. Joint compound is supplied premixed or as a powder mixed with water.

Obtaining a perfectly smooth and finished seam between drywall joints is a difficult task, that requires significant artistry in the current state of the art. The process of smoothing the joint compound covering a wallboard joint is called "feathering" or "floating" and requires substantial skill and time in order to obtain a high quality smooth finish with an invisible seam. When a joint is feathered, one or more layers of joint compound are applied a an imperfection on the surface of the wall, such as a join between two sheets of drywall, and the joint compound over the imperfection is manually smoothed by repeated scrapings with a tool such as a taping knife, a joint knife, and/or sanding and sponging. The object of feathering is to smoothly taper the joint compound over the imperfection.

Joint compound is typically applied with a combination of taping knives, joint knives, and putty knives, which conventionally have a straight edge the working edge. The term "working edge" means the edge of the tool in primary contact with the wall and/or joint compound, which is typically distal from the handle of the tool.

SUMMARY OF THE INVENTION

This invention discloses a calibrated hand tool that improves the feathering or floating process in applying joint compound to the joints in finishing of drywall construction. Also disclosed are methods of using the inventive tool to apply joint compound to butt joints and inside corner joints.

In an embodiment, the tool maybe a drywall taping knife with a slightly flexible planar blade non-detachably and non-slidably affixed to a handle, the blade having a concave arcuate working edge distal to the handle, wherein the working edge has a corner on each end of the working edge and the concave arcuate curve extends the entire length of the working edge to each corner, and wherein the blade has two side edges on each side of the working edge. The handle has an approximately cylindrical body with grip diameter of between 1" to 2", which allows fingers to wrap comfortably around the handle, which reduces stress and impact on hands, fingers and wrist and prevents slippage.

In an embodiment, a method is provided for applying joint compound to a butt joint between two boards that form a planar surface, by applying a layer of joint compound to the butt joint, a layer of tape, and a second layer of joint compound, wherein the tool as disclosed herein with a concave arcuate working edge is pulled along the joint so the corners of the working edge of the tool are in contact with the planar surface and aligned approximately perpendicularly to the direction of the pulling. The pulling of the tool maybe angled at an angle defined by the surface of the wall, the corners of the working edge of the tool, and the plane of the blade, to spread and self-feather the second layer of joint compound over the tape. After applying the joint compound, the surface can be slightly convex. The blade is slightly bendable, which allows adjustment of the concave arching of the blade with respect to the wall, when force is applied on the handle while pulling the tool.

In an embodiment, a method is provided for applying joint compound to an inside corner joint between two wall board surfaces, wherein the surfaces are in an approximately perpendicular orientation, by applying a layer of joint compound to each corner surface of the corner joint, a layer of tape to each corner surface, and a second layer of joint compound over the tape, and pulling the tool as disclosed herein having a concave arcuate working edge along the axis of the edge. The pulling of the tool may be crabbed slightly by keeping the distal corner of the working edge slightly behind the proximal corner of the working edge such that the proximal edge of the blade is not in direct contact with the other approximately perpendicular surface of the inside corner. The pulling of the tool may form an angle defined by a surface of the wall, the corners of the working edge of the tool, and the plane of the blade, to spread and self-feather the layer of joint compound over the bead

DETAILED DESCRIPTION

This disclosure provides tools and methods that may be useful for the application of joint compound to butt joints and inside joints of drywall construction. The inventive tool may be provided in the format of a taping knife, or similar tool, and has a concave arcuate working edge in which the arcuate curve extends the entire length of the working edge. As this tool is dragged along a seam in drywall construction to spread joint compound, the concave arcuate curve smooths the joint compound, self-feathering the joint compound over the drywall tape. The self-feathered joint is normally clean enough that it has a finished appearance, without the application of an additional finish coat. The self-feathered joint can be directly painted over to give a smooth wall.

Figure 1:
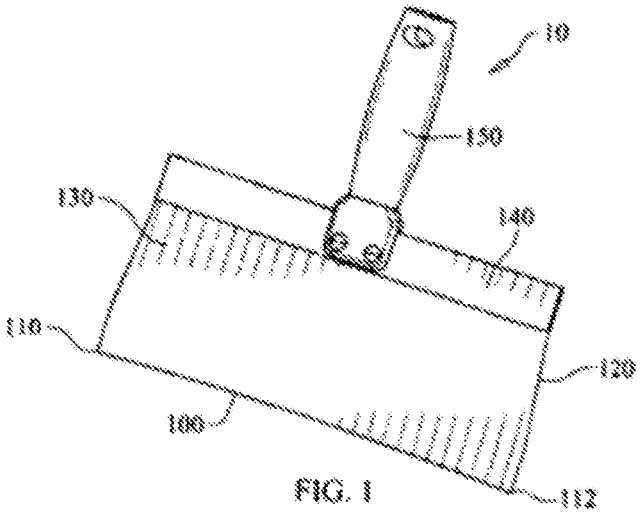
FIG. 1 is a perspective view of a drywall taping knife embodiment of this invention.
Figure 5:
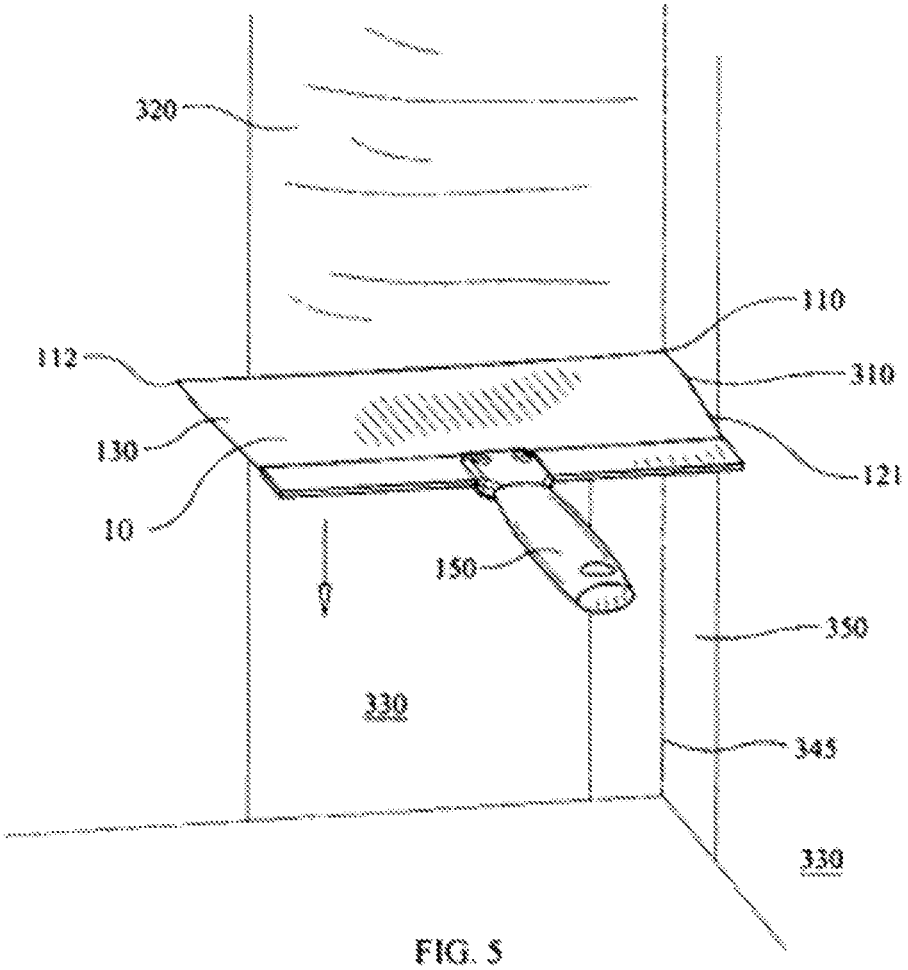
FIG. 5 is a perspective view of a method of applying joint compound to an Inside corner joint.
Figure 6:
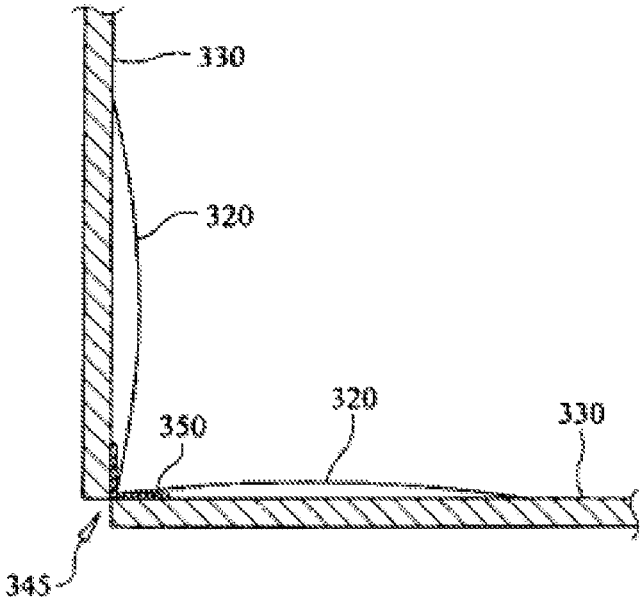
FIG. 6 is a cross section view of a finished inside corner joint.

Previous disclosures have provided distinctly different approaches to the problem of feathering joint compound or plaster over drywall seams. For example, U.S. Pat. No. 2,800,672, discloses a complex device for applying plaster to drywall with two blades in which a blade with a curved edge is slidable between a working and non-working position to apply a curved layer of plaster, but not a layer that is self-feathered. In the '672 patent, a finish coat must be applied (FIG. 5-6, 1:39-41).

Figure 2:
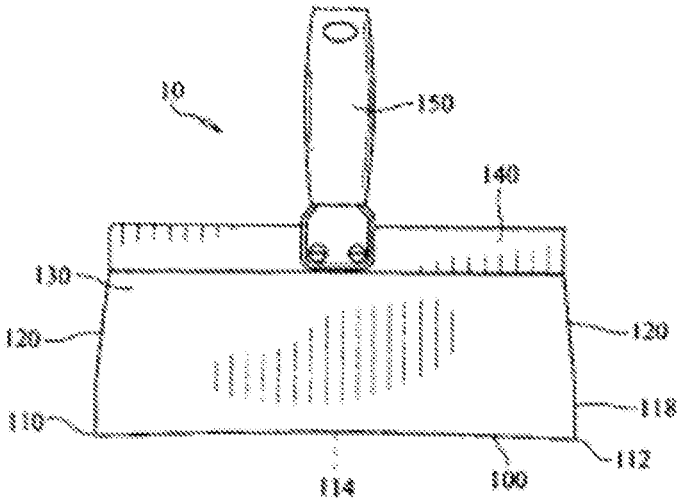
FIG. 2 is a front view of a drywall taping knife embodiment of this invention

US patent publication 2002/0002754 discloses drywall tools with a concave portion on the working edge, but having flat portions (see FIGS. 2, 16a and 16b).

US patent publication 2008/0295435 discloses drywall tools with various curved edges. FIG. 3A in the '435 publication appears to disclose a working edge with a concave portion (item 340 and 340'), but requiring non-concave portions on the ends (item 335 and 335'). In addition, a tool in the '435 publication has an arched blade, not a planar blade as in the invention disclosed herein ('435 FIG. 3b).

U.S. Pat. No. 7,647,668 provides taping knives and joint knives with a notched portion on the working edge to aid in making flat and even drywall joints.

The difficulty in finishing drywall comes from the feathering of the joint compound and then sanding the joint compound to obtain a finish surface without perceivable edges. This requires time and skill. When feathering a joint the extra mud is usually removed by multiple strokes, with at least one stroke on one side of the seam by passing the edge of the tapping knife distal to the seam to the wall and the edge closer to the seam away from the wall, another similar stroke on the other side of the seam and an additional stroke going over the seam and the whole joint. Removing the extra mud, however, often requires repeating the step several times. After the joint compound is feathered it typically has to be further smoothened by using a wet sponge or cloth and/or by sanding. The tool of the subject invention is designed to spread and self-feather a second layer of joint compound to provide a smooth continuous wall surface with one or two strokes. One object of the invention is to provide for a tool with minimum number of components which is easy to use and clean and economical to manufacture.

Another object of the present invention is to provide for a tool which is suitable for extended use, comfortable to manipulate and requiring minimal force to operate.

A further object of the present invention is to provide for a tool which provides additional control over the degree of smoothing of the convex surface of the wall depending on its specific characteristics.

As disclosed herein, a hand tool is provided for the application of joint compound on wall board, with a planar slightly flexible blade fixed to!! handle, the blade having a concave arcuate working edge distal to the handle, wherein the working edge has a corner on each end of the working edge and the concave arcuate curve extends the entire length of the working edge to each corner, and wherein the blade has two side edges on each side of the working edge. There is only a single blade in this tool, in contrast to prior art tools with dual blades.

Moreover, the taping knife of the present invention is essentially rigid in the direction perpendicular to handle, which is its longitudinal direction (X), yet when pressure is applied it is slightly flexible in the direction parallel to the handle, its lateral direction (Y).

FIGS. 1 and 2 illustrate a taping knife embodiment (10) of this invention. In this embodiment, a planar blade 130 blade has a concave arcuate working edge 100, wherein the arcuate curve extends completely to corner edges 110 to 112. The blade has side edges 120. The blade is mounted in blade mount 140. Handle 150 is non-detachable and non-slidably affixed to the blade mount 140. In the taping knife embodiment, the planar blade 130 of the tool is approximately trapezoidal wherein the working edge 100 (notwithstanding the curve in edge 100 defined by center point 114) and the edge 140 bearing the handle are parallel and edge 100 forms the longer dimension of the trapezoid, while the side edges 120 are not parallel, except for the portions 118 close to the working edge which are parallel.

The working edge 100 in FIGS. 1 and 2 is defined by corners 110 and 112, and by center point 114. Center point 114 is equidistant between corners 110 and 112. The working edge 100 is not a straight line, but rather defines a concave shape, with an inwardly curved profile, also referred to here as an arcuate edge, as depicted by the elevation view in FIG. 2. The inward arch of the curve of working edge 100 is curved towards the handle 150. Thus, because of the concave arcuate curve of working edge 100, if tool 10 was placed in an approximately perpendicular orientation to a planar flat level surface, such that corners 110 and 112 were in contact the surface, center point 114 would be elevated above the surface by several millimeters. Center point 114 would not be in contact with the planar surface. However, as the blade is slightly flexible, if force is applied on the handle in the direction of the wall while the tool is pulled in a direction parallel to the wall, the angle of the blade with respect to the wall surface and subsequently the thickness of the layer of joint compound may be adjusted. This characteristic is important when applying the joint compound to walls that have irregular or bumpy sections.

Drywall taping knives are typically 6 in. (15 cm), 8 in. (20 cm), 10 in. (25 cm), 12 in. (30 cm), and 14 in. (36 cm) widths, which allows the curvature of mud in the cross section to be essentially invisible, and the seam can be painted over directly.

The blades are typically made of steel that is about 0.15 mm to about 1.0 mm thick. Other materials may be used for the blade, for example, aluminum or plastic, if they are sufficiently stiff to provide rigidness in the longitudinal direction of the blade and some flexibility in its lateral direction, when pressure is applied.

In an embodiment, a tool according to this invention may be used to self-feather the application of joint compound to a taped butt joint between two sheets of drywall. In an embodiment, a butt joint may be finished using the inventive tool by applying a layer of joint compound to the joint (not shown) and embedding joint tape 301 in the layer of joint compound so that the tape covers the seam 340 between the two sheets. A conventional joint or tape knife may be used in this step. The joint compound in this step is smoothed with the knife and may be allowed to dry.

In a second step of this embodiment, a larger quantity of joint compound may be applied over the tape (300) with joint compound using an inventive tape knife 10. A fairly thick layer of joint compound may be smeared over a length of the taped joint. A tape knife 10 according the instant invention, with a concave arcuate curvature along the working edge of the blade, is run along the joint.

Figure 3:
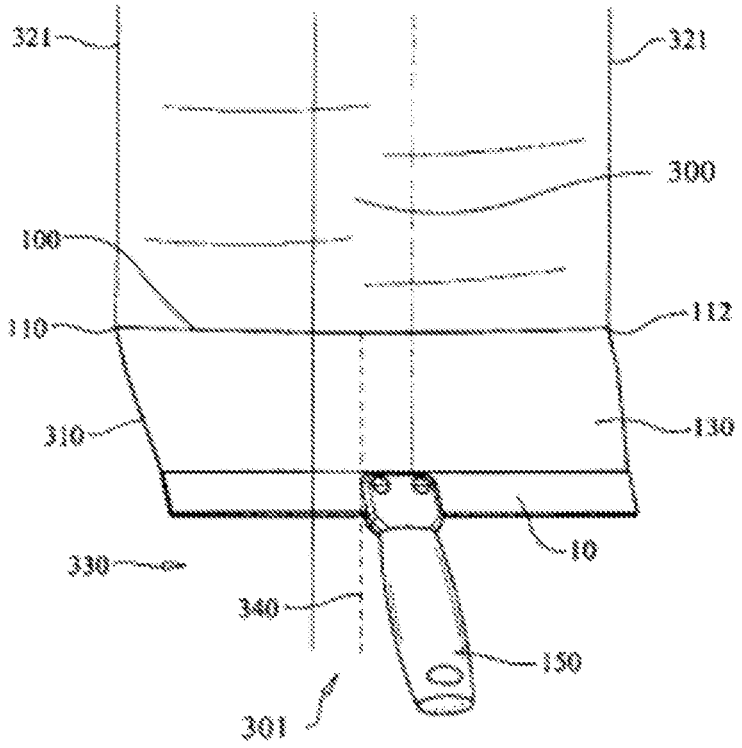
FIG. 3 is a perspective view of a method of applying joint compound to a butt joint
Figure 4:
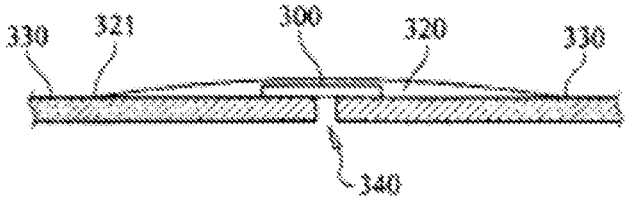
FIG. 4 is a cross section view of a finished butt joint with essentially invisible curvature of the mud.

With a butt joint along a vertical or horizontal seam 340 (FIGS. 3 and 4), (the gap between the two sheets of drywall 330 is exaggerated in FIG. 4 for clarity; more typically, the two sheets of drywall will be in contact with each other along the seam 340 of the joint), the direction of the pulling of the tape knife 10 will be along the seam with the blade corners 110 and 112 aligned in a perpendicular orientation to seam, as shown in FIG. 3. By applying a slight force and adjusting the angle of the blade with respect to the wall surface, the thickness of the layer of joint compound 320 may be adjusted. The angle of the blade for this purpose is defined by the plane of blade 130 and the wall surface 330, with the vertex the being an imaginary straight line between edges 110 and 112 of the working edge of the blade. The ends of the layer of joint compound 321 will be defined by the edges of the blade 110 and 112.

By using this technique with tool 10, a clean self-feathered layer 320 of joint compound with clean edges 321, and requiring minimal sanding or sponging as compared with conventional feathering techniques, may be obtained. The joint tape 301 (FIG. 3) is smoothly covered by the joint compound. The joint tape covered by a layer of joint compound by the inventive tool is depicted as 300 in FIGS. 3 and 4. Optionally, a third layer of joint compound may be applied, often called a finish coat, with a wider knife 10 than used in the second coat of joint compound.

In the conventional application of joint compound, the user must manually adjust pressure on the knife to feather the joint and obtain a smooth finish. This typically requires sponging of the surface, while still wet, and sanding once dry, to obtain a perfectly smooth finish. By using the tool of the instant invention, the application of a smooth coat of joint compound with the tools is much more efficient, resulting in less of a need for sponging or sanding when complete.

In another embodiment, the tools as disclosed herein can be used to evenly spread joint compound on inside corner joints. In an embodiment, two edges of drywall forming an inside corner 345 (FIGS. 5 and 6) are provided. For clarity in this explanation, the two surfaces can be described as being on an X and Y axis and forming an X and Y surface according to basic geometry conventions, when viewed in cross section as shown in FIG. 6.

A layer of joint compound may be applied to the edge of each X and Y surface, and corner drywall tape 350 is applied to the corner. Many types of drywall tape are provided with a crease along the centerline, allowing the tape to be folded 90° along the centerline, so that a single line strip of tape fits evenly to both X and Y surfaces in the corner. Using a taping knife, the corner drywall tape 350 is embedded in the layer of joint compound with one half the tape (along the long axis) in the contact with the X surface, and one half the tape in contact with Y surface, with the centerline of the tape nested in edge 345.

In a second step of this embodiment, shown in FIG. 5, a second quantity of joint compound is placed along one side of the joint. For convenience only, this will be referred as the X surface. A taping knife 10 according to the instant invention, is then run along the X surface with inside corner 110 of tool blade 130 in intimate contact with the inside of edge 345. A quantity of excess joint compound 310 is pulled under tool blade 130.

As tool 10 is pulled along the seam of corner 345, a smooth, self-feathered layer 320 of joint compound will be established along the X surface, covering tape 350 with a smooth layer of joint compound.

In an embodiment, tool 10 may be crabbed slightly while it is pulled along the X surface in the corner, so that outside corner 112 of blade 130 is slightly behind inside corner 110. In this configuration, the inside (or proximal) blade edge 121 is not in contact with the Y surface. Tool 10 may be pulled at an angle relative to the X surface 330, defined by handle 150 corner 112, and surface 330 can be adjusted to adjust the thickness of joint compound layer 320.

In this embodiment, a similar technique is employed to apply a self-feathered layer of 320 of joint compound on the Y surface. Thus, after a self-feathered layer of joint compound is applied to the X surface, a quantity of joint compound is then applied to the Y surface of the joint, and tool 10 or 20 is pulled along the Y surface with inside corner 112 in contact with corner. The tool is crabbed slightly to the inside edge so that edge 121 is not in contact with X surface. This procedure will apply a smooth layer of joint compound 320 to the Y surface.

The result is shown in cross section in FIG. 6, depicting two sheets of drywall 330 joined with an inside corner joint, and smooth feathered layers of drywall mud 320 spread over the corner tape 350.

Calibration Summary

This invention pertains to a calibrated taping knife or joint knife, specifically to a knife having a concave arcuate calibrated curved edge, in order to allow a new method of applying joint compound to a section of drywall, wherein a lower level of skill is required allowing one who is not skilled in the art of taping drywall seams to achieve a perfectly smooth continuous surface, as well as self-feathering the joint compound over the drywall joint tape. The new technique is advantageous in that it permits the operator to quickly and easily control the degree of application to which the concave arcuate working edge blade design is highly accurate.

The calibration disclosed herein for the concave arcuate curved blade is based on the thickness of drywall joint tape, approximately 0.1 mm, the working edge 100 in FIGS. 1 and 2 of the drawings as defined by the corners 110 and 112, and by the center point 114, wherein center point 114 is slightly elevated above the surface by 2.5 mm, with an inwardly curve as depicted in FIGS. 1 and 2. When tilting the angle of the blade as it is dragged along a joint by approximately 30 degrees and applying pressure to the handle, the blade is slightly flexible, decreasing the concave arcuate curve's calibration from 2.5 mm to about 1.0 mm with respect to the wall surface. The thickness of the layer of joint compound is adjusted by this tilting of the tool, providing improved control and a self-feathered layer of joint compound when pulling the inventive hand tool by an operator. Further research and development by the inventor showed that the inventive tool can reach into the corners, allowing it to apply joint compound smoothly on inside corners.

In conclusion, the industry has been in search of a new inventive tool since 1950, and a method to improve the art of getting a flat smooth drywall joint finish from an art to more of a science. A scientific breakthrough has been made after two decades of studying professional tapers, their methods, and incorporating the human touch into the tool as a result.

The invention claimed is:

1. A hand tool with a calibrated concave arcuate curve blade for the application of joint compound to a drywall joint comprising:

a handle with a single planar blade disposed at one end of the handle at one edge of the blade, the blade having a working edge opposed to the side of the blade associated with the handle, the working edge and the edge bearing the handle form a longer dimension of the blade;

the working edge of the blade extending an entire length of the working edge from corner to corner of the working edge which defines the calibrated concave arcuate curve;

the calibrated concave arcuate curve having an arcuate edge arc having a depth between 1.0 mm and 2.5 mm; and the blade is slightly flexible so as to flex laterally to reduce the arcuate edge arc in use.

2. The hand tool of claim 1 wherein the planar blade is approximately rectangular.

3. The hand tool of claim 1 therein the planar blade is approximately trapezoidal.

* * * * *